US005390957A

United States Patent [19]

Metzler

[11] Patent Number: 5,390,957

[45] Date of Patent: Feb. 21, 1995

[54] MAP HOLDER

[76] Inventor: Joseph T. Metzler, 5114 New Kent Rd., Wilmington, Del. 19808-2706

[21] Appl. No.: 12,416

[22] Filed: Feb. 2, 1993

[51] Int. Cl.[6] ..... A63C 11/22

[52] U.S. Cl. ..... 280/819; 40/517; 40/904

[58] Field of Search ..... 40/514, 517, 607, 660, 40/904; 160/120, 368.1, 903; 224/162; 280/809, 819

[56] References Cited

U.S. PATENT DOCUMENTS

| | | | |
|---|---|---|---|
| 344,444 | 6/1886 | Harrington | 40/517 |
| 764,301 | 7/1904 | Osborn | 40/317 |
| 764,997 | 7/1904 | Finch | 40/317 |
| 1,298,739 | 4/1919 | Langford | 40/517 X |
| 1,583,998 | 5/1926 | Richey | 40/517 |
| 1,671,214 | 5/1928 | Wilson | 40/517 |
| 3,884,351 | 5/1975 | James | 40/517 |

*Primary Examiner*—Kenneth R. Rice
*Assistant Examiner*—Michael Mar

[57] ABSTRACT

A map holder is attached to a ski pole. The map is attached to the left side of the planar material of the holder using adhesive tabs. The map is attached to the right side of the planar material of the holder using a strap. The strap is free floating in its midregion relative the planar material. The map is attached to the free floating region of the strap which allows the map to roll up free floating on its own radius.

4 Claims, 1 Drawing Sheet

MAP HOLDER

BACKGROUND OF THE INVENTION

1. Field of the Invention

The invention relates to a map holder and more particularly a map holder for attachment to a ski pole.

2. Description of the Prior Art

U.S. Pat. No. 764,301 discloses a spring map roller that allows an enclosed document or map to be rolled out like a shade for viewing. The patent fails to specifically disclose the use of a strap on a planar material backing that allows the document to roll up free floating on its own radius. The document of the patent is attached directly to the roller and is not readily replaced by a different document on a backing that supports the document in use and when rolled up.

U.S. Pat. No. 764,997 discloses a cane comprising a spring loaded roller that allows a map or document to be rolled out for viewing. This patent suffers the same deficiencies as the above patent.

SUMMARY OF THE INVENTION

A sheet holder with a spring biased elongated shaft. A planar material is fastened to the shaft and can be rolled up or unrolled from the shaft. A mounting structure holds a sheet on the planar material so that one side of the sheet is free floating relative the planar material to permit the sheet and planar material to roll up on different radii.

The sheet holder is fastened to a ski pole on cans or like object.

DETAILED DESCRIPTION OF A PREFERRED EMBODIMENT

Figure 1:
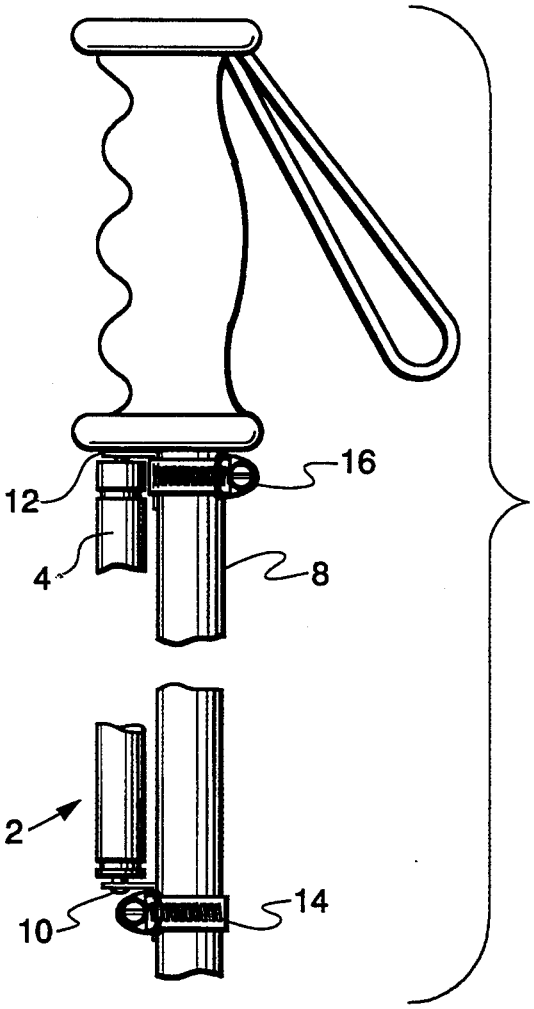
FIG. 1 is a front view of the sheet holder on a ski pole.

Referring to FIG. 1, the sheet holder 2 has an elongated shaft 4 with a spring means therein to bias the shaft to rotate in one direction and resist rotation in the other direction to wind up the spring. The sheet holder is shown fastened to a ski pole 8. The shaft 4 is mounted on two right angle supports 10 and 12 which in turn are affixed to the ski pole 8 with screw clamps 14 and 16. It is obvious that different means may be used to fasten the sheet holder on or within the ski pole. The best mode for the construction of the shaft is as a hollow shaft with the spring therein. A solid shaft could be used with a coil spring on the end of the shaft causing rotation of the shaft.

Figure 2:
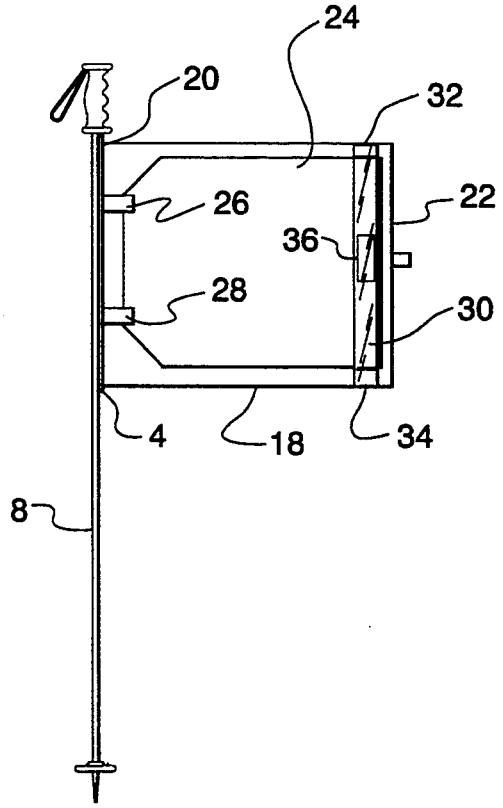
FIG. 2 is a front view of the sheet holder in its extended position.

FIG. 2 shows the sheet holder with the planar material 18 in an extended position. Planar material 18 has two sides 20 and 22. Side 20 is affixed to the shaft 4 while side 22 is free from the shaft and can be grasped to unroll the planar material 18 that is normally biased to a rolled up or wrapped position on that is normally biased to a rolled up or wrapped position on the shaft 4. The spring means rotates the shaft 4 in one direction to wrap the planar material 18 around the shaft 4 in a rolled up state on the shaft 4. Pulling on side 22 overcomes the resistance of the spring to unwrap the planar material from the shaft 4.

A mounting means is used to affix the sheet or map 24 to the planar material 18. The mounting means is composed of at least two short tabs 26 and 28 or one long tab of double sided adhesive tape and a transparent strap 30. The two tabs are positioned adjacent side 20 of the planar material 18. One adhesive side of a tab holds the tab on the planar material 18 and the other adhesive side of a tab holds the sheet 24 releasably to the tab. The strap 30 is affixed at its ends 32 and 34 to the top edge and bottom edge of the planar material 18. The rest of the strap is not affixed to the planar material 18. An adhesive tab 36 is affixed to the midregion of the strap 30 on the side of the strap adjacent the planar material 18. When a sheet 24 is inserted under the strap 30, the tab 36 holds the sheet relative the strap. The tab 36 could be eliminated and the strap alone could hold down the sheet 24. Alternately the tab 36 and sheet 24 could be placed above the strap 30. The side of the sheet adjacent the side 22 of the planar material 18 is free floating relative the planar material 18. When the planar material 18 with the sheet 24 is rolled up on the shaft 4, the planar material 18 and sheet are held together in position by the tabs 26 and 28. The other side of the sheet is free floating with regard to the planar material and both the planar material and sheet will roll up on the shaft with different radii to provide a tight roll up of the material and sheet. Without the one free floating edge, the sheet at the side 22 of the planar material 18 will pull loose from the planar material or buckle/-bunch up at the edge 22 of the planar material 18. The strap 30 could be replaced with a series of elastic straps fastened on the edge 22 of the planar material 18. These elastic straps would extend parallel to the direction of movement of the planar material. The sheet edge is fastened to the left edge of the elastic straps.

The sheet holder can be fastened to a ski pole, cane, frame of a bicycle, tiller of a boat, a flat surface, etc.

What is claimed is:

1. A sheet holder comprising:

a) an elongated hollow shaft, spring means for biasing the shaft to rotate in one direction and resist rotation in an opposite direction, b) a planar material with two opposite sides, one side being affixed to the shaft and the second side being free from the shaft, said second side having two corners, said spring means rotates the shaft in one diretion to wrap the planar material around the shaft, the second side of the planar material being movable away from the shaft to rotate the shaft in an opposite direction to unwrap the planar material from the shaft, and c) mounting means for affixing a sheet with two side portions to the planar material with one side portion of the sheet being firmly affixed at the one side of the planar material and the second side portion of the sheet being freely floating at the second side of the planar material, but held adjacent the planar material, the mounting means including a strap having opposite ends, the strap being affixed only at the opposite ends to respective upper and lower edges of the planar material proximate the corners of the second side of the planar material, said second side portion of the sheet being located between the strap and the second side of the planar material, and an adhesive tab affixed to the midregion of the strap, the adhesive tab being located between the strap and the second side portion of the sheet for securing the midregion of the strap to the sheet while permitting the midregion of the strap to be free floating relative to the planar material.

2. A sheet holder as set forth in claim 1 wherein:

a) the sheet material is a map.

3. The combination of a sheet holder with a ski pole comprising:

a) an elongated hollow shaft, spring means for biasing the shaft to rotate in one direction and resist rotation in an opposite direction, b) a planar material with two opposite sides, one side being affixed to the shaft and the second side being free from the shaft, said second side having two corners, said spring means rotates the shaft in one direction to wrap the planar material around the shaft, the second side of the planar material being movable away from the shaft to rotate the shaft in an opposite direction to unwrap the planar material from the shaft, and c) mounting means for affixing a sheet with two side portions to the planar material with one side portion of the sheet being firmly affixed at the one side of the planar material and the second side portion of the sheet being freely floating at the second side of the planar material, but held adjacent the planar material, the mounting means including a strap having opposite ends, the strap being affixed only at the opposite ends to respective upper and lower edges of the planar material proximate the corners of the second side of the planar material, said second side portion of the sheet being located between the strap and the second side of the planar material, and an adhesive tab affixed to the midregion of the strap, the adhesive tab being located between the strap and the second side portion of the sheet for securing the midregion of the strap to the sheet while permitting the midregion of the strap to be free floating relative to the planar material.

4. The combination as set forth in claim 3 wherein:

a) the sheet material is a map.

* * * * *